US005282631A

United States Patent [19]

Baker

[11] Patent Number: 5,282,631

[45] Date of Patent: Feb. 1, 1994

[54] CROSS-WORD BOARD GAME CONSTRUCTION SYSTEM AND METHOD

[76] Inventor: Dorothee A. Baker, 4123 Ten Oaks Rd., Dayton, Md. 21036

[21] Appl. No.: 948,328

[22] Filed: Sep. 22, 1992

[51] Int. Cl.[5] ..... A63F 3/00

[52] U.S. Cl. ..... 273/272; 273/299; 273/153 R; 434/171; 434/177; 446/901

[58] Field of Search ..... 273/272, 299, 155, 157 A, 273/159, 153 R; 434/97, 102, 171, 172, 173, 177, 197, 426; 446/901

[56] References Cited

U.S. PATENT DOCUMENTS 1,094,011 4/1914 Peek ..... 273/155 X
2,333,731 11/1943 Monroe et al. ..... 273/155
2,878,586 3/1959 Ohlsson ..... 446/901 X

*Primary Examiner*—Vincent Millin
*Assistant Examiner*—William M. Pierce
*Attorney, Agent, or Firm*—Morton J. Rosenberg; David I. Klein

[57] ABSTRACT

Word construction system (10) is provided to allow a user to form crossword puzzles or other indicia related games. System (10) includes strips of tape (16) which are divided into zoned elements (18, 18' and 18'') having individual regions (20) on each where indicia (14) may be placed. The user then manipulates and relocates zoned elements (18, 18' and 18'') using common indicia (14) to allow one zoned element to be an overlay for another zoned element. In this manner, there is provided a mechanism and method where a user may form a word game which is individualistic in nature and may have differing patterns for the same words or indicia (14) used.

18 Claims, 2 Drawing Sheets

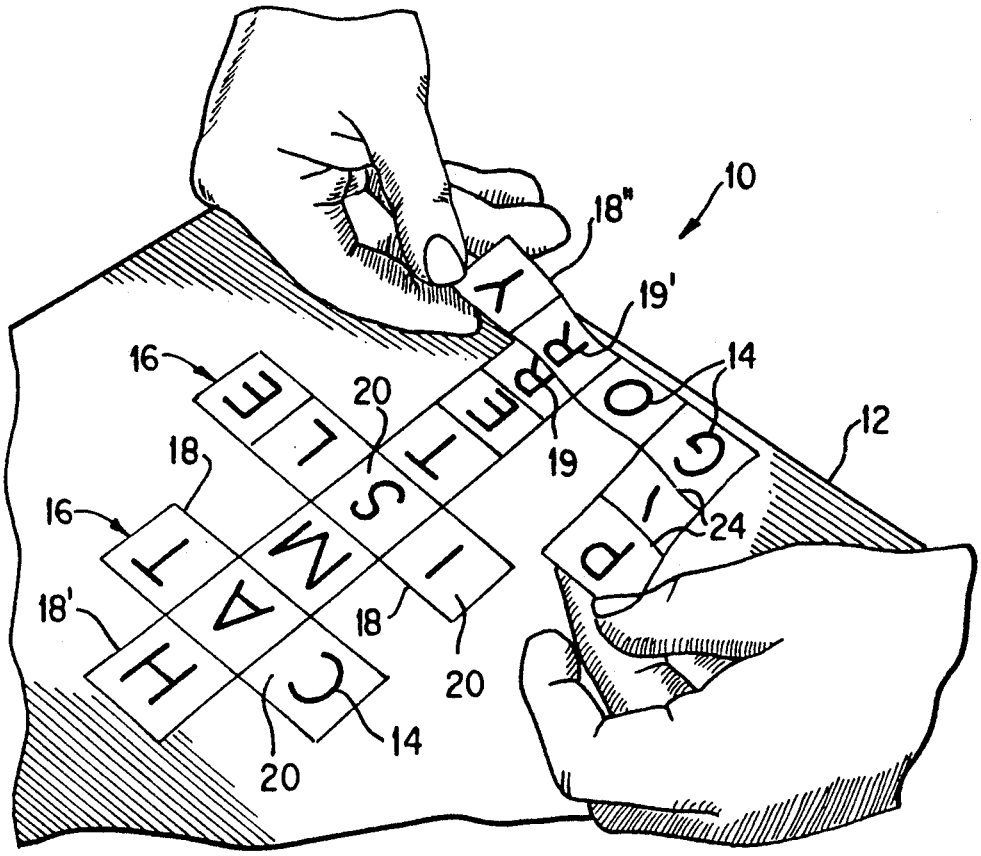
FIG. 1
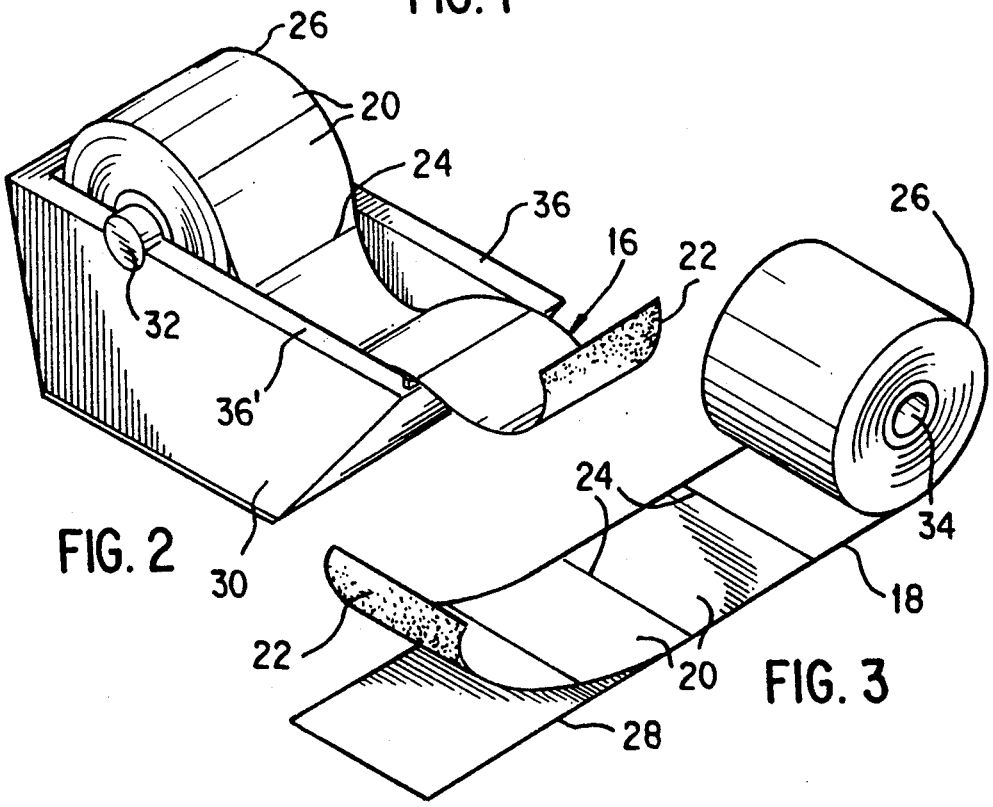
FIG. 2
FIG. 3

CROSS-WORD BOARD GAME CONSTRUCTION SYSTEM AND METHOD

BACKGROUND OF THE INVENTION

1. Field of the Invention

This invention pertains to word construction systems and method of forming such word construction systems. It is to be understood that this invention relates to a system and method which is distinct and different from standard crossword puzzle games where the user clues provided to insert words into proper areas of a crossword puzzle. The subject invention pertains to a word puzzle construction system and method which allows the user to have simple and effective control in the development of a word puzzle while reinforcing vocabulary, spelling and concepts relating to a particular subject. The subject invention concept requires attention to and the investigation of letters, words and numbers by the user while allowing the manipulation and relocation of zoned elements carrying particular indicia to be placed and accommodated by the individual choices of the user. As will be described in the following paragraphs, the user may quickly and easily alter or change the overall pattern dictated by the user's creative drive. Still further, this invention pertains to a word construction system which uses tape being divided into zoned elements carrying predetermined areas where particular indicia may be formed. Additionally, a plurality of zoned elements may be interrelated to form a pattern on a base surface which may then be used by the user to provide an overall pattern for the particular word game being constructed. Additionally, this invention relates to a system of publication where a multiplicity of users may be provided with the same words or indicia and complete a patterned word or indicia game completely unique to the user by use of different key definitions. More in particular, this invention directs itself to a word construction system which allows the user to manipulate, overlap and relocate different zoned elements with relation to common indicia formed on such zoned elements. Other embodiments of the subject invention concept relate to the utilization of flexible, metallic backed or impregnated zoned elements which may be mounted on magnetized boards to allow ease of manipulation and relocation of zoned elements. Alternatively, flexible strips of magnetized zoned elements may be releasably mounted on metallic boards to provide a word construction system within the invention concept herein described. Still further, the subject invention pertains to word construction games which allow for a user to transfer interrelated zoned elements from a first sheet layer to a second sheet layer in accordance with standard crossword puzzle design considerations.

2. Prior Art

Games that lend themselves to investigating letters, words and numbers are well known in the art. Some such types of games include crossword puzzles, Hangman, and other types of games such as Wheel of Fortune. However, such types of games which may be useful in learning activities as well as used as an enjoyable pastime, do not include, extend or involve the creativity of a user that comes from the development of formation of the game itself.

The best prior art known to Applicant in the construction of word or indicia games includes U.S. Pat. Nos. 4,828,499; 4,299,578; West German Patent

#2301185; French Patent #2540003; Great Britain Patent #569156; U.S. Pat. No. 2,782,530; Great Britain Patent #322655; U.S. Pat. No. 5,055,049; and, U.S. Pat. No. 5,018,975.

As shown in U.S. Pat. No. 4,828,499, complicated apparatus for constructing crossword puzzle systems are known. Such systems include housings wherein particularly solid colored pieces are magnetically mounted on a grid system with other magnetic type pieces being inserted with particular indicia. Such prior art systems do not allow the user to insert indicia on particular zoned elements and in particular regional elements and then manipulate individual zoned elements with respect to each other to form an interrelating type of pattern. Such relocation of entire zoned elements allows for the creativity of the differing patterns to be brought out in each type of puzzle being formed.

U.S. Pat. No. 4,299,578 provides for a crossword system and game apparatus method for creating crossword puzzles. However, although grid type indicia are used, the system is complicated in nature, and as previously described, does not provide for the relocation and differing placement of particular zoned elements to provide the advantages and objectives of the invention concept.

SUMMARY OF THE INVENTION

A word construction system and method of forming same which includes a base surface and mechanism for removably applying a multiplicity of zoned elements to the base surface. The zoned elements have predetermined regions formed thereon where indicia is applied to a zoned element for forming indicia interrelationships with other zoned elements. In this manner, a predetermined patterned type of word game is constructed by the user.

BRIEF DESCRIPTION OF THE DRAWINGS

FIG. 1 is a partially cutaway view of the word construction system of the subject invention concept showing placement of zoned elements on a base surface;

FIG. 2 is a perspective view of a tape dispenser showing a roll of tape contained therein for dispensing individual zoned elements containing one or a plurality of predetermined regions.

FIG. 3 shows a roll of tape having zoned elements with an adhesive backing face and a carrier tape;

DESCRIPTION OF THE PREFERRED EMBODIMENTS

Figure 4:
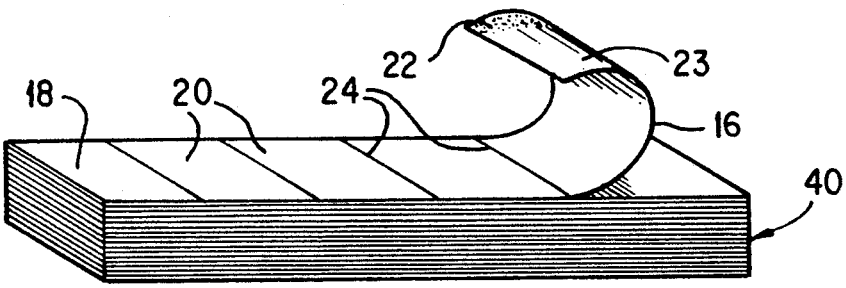
FIG. 4 is an embodiment of the subject invention concept showing a pad of zoned elements.

Referring now to FIGS. 1–7, there is shown word construction system 10 and a method of forming same to allow a user to construct a wide variety of indicia related games such as crossword puzzles where interrelated elements are positionally located in particular areas to form a game system which may be played for the enjoyment of others. For the purposes of this invention concept it is to be understood that the use of words or particular letters shall encompass other symbols which in general are indicia such as mathematics symbols or mathematics indicia which allow for the positioning and interrelationship of such indicia to provide word construction system 10.

Crossword puzzles are well known in the prior art and provide enjoyment and a pastime for large numbers of users. The subject invention concept is directed to an educational tool specifically directed to children however not limited thereto which pertains to the construction of word games and as an example shown in FIGS. 1-7 particularly to crossword puzzles. Crossword puzzles are educational, challenging and provide a recreational pastime. However, it has been now found that the preparation and the forming of a particular word game has a vast additional educational and enjoyment value for users. Thus, in a classroom setting, through use of word construction system 10 and the method associated therewith as herein described, vocabulary can be increased while allowing a group of users to express their individuality during the creation of a word game. Additionally, through use of the same basic words a group may provide a unique type of word construction and provides for the advantages of allowing the user to investigate word meanings and definitions, allows for the user to increase their creativity in defining clues for preparation of word construction system 10. Reinforcement of vocabulary development is provided through use of the subject invention concept while reinforcing and developing an increased ability to create a completely unique to themselves system 10 which may be used by others. This has been found to provide a positive self-image for the person who is constructing system 10 while essentially making the learning process of word definitions, spelling and vocabulary increase a somewhat painless and enjoyable endeavor.

Referring now to FIG. 1, word construction system 10 is generally applied to base surface 12 in order to provide an overall interrelationship between various indicia 14 as will be described in following paragraphs. Use may be made of tape strips 16 which provide for a mechanism of removably applying zoned elements 18 to base surface 12. For purposes of understanding the invention concept, zoned elements 18 as shown in FIG. 1 is a set of predetermined regions 20 which make up a particular zoned element 18. Thus, for illustrative purposes, as shown in FIG. 1, the indicia 14 which is shown making up the word "CAT" is formed on tape strip 16 which is provided with zoned element 18 having predetermined regions 20 where the individual letters of the word "CAT" is formed in a separate and individual predetermined region 20 within zoned element 18 on tape strip 16.

As is shown in FIG. 1, various tape elements 16 are used to form an indicia interrelated grouping of words forming a portion of a crossword puzzle. As is seen, zoned element 18 is placed in overlying relationship with zoned element 18' and further in positional relation with respect to zoned element 18'' to provide the grouping of interrelated words. As is seen, zoned element 18 forms the word "CAT" with particular indicia 14 being placed in each region 20 making up zoned element 18. Zoned element 18 is placed in overlying relation with zoned element 18' forming the letters "HAMSTER" with the letter "A" in a common with zoned element 18. Finally, zoned element 18'' making up the word "GORY" is placed in positional and overlying relationship with zoned element 18. As is seen in FIG. 1, zoned element 18' provides the word "HAMSTER" while zoned element 18'' provides the word "GORY". The common indicia "R", elements 19 and 19' are placed in overlying relation to form a portion of the completed puzzle. In this manner, an entire crossword puzzle may be formed on base surface 12 for transference to other media which will allow the user to provide a word game adaptable for use by others.

As shown in FIGS. 1, 2 and 3, tape strips 16 which provides a mechanism for removably applying zoned elements 18 to base surface 12 include a non-permanent adhesive coating 22 formed on one face of tape strip 16 opposite to the face upon which zoned elements18 and predetermined regions 20 are formed. Adhesive coating 22 may be a mild adhesive such as that provided with "POST-IT" note paper, which is a Registered Trademark and commercially available from 3M Corporation, St. Paul, Minn. Through use of adhesive coating 22, individual zoned elements 18 may be repeatedly placed on base surface 12 in differing positional locations to allow the user a simple and effective way of relocation of zoned elements 18 in relation to other zoned elements being located to construct the word game. Tape layer 16 includes individual markings 24 formed on the face of tape layer 16 opposite to the face upon which adhesive coating 22 is formed. Markings 24 particularly define the plurality of individual regions 20 upon which indicia 14 may be formed as shown in FIG. 1. A plurality of regions 20 thus define a particular zoned element 18, 18' or 18''.

Where tape layer 16 is formed into a roll 26, carrier tape 28 may be used as shown in FIG. 3. Carrier tape 28 is commonly used with adhesive backed tapes and allows for tape 16 to be rolled and unrolled for dispensing purposes. As seen in FIG. 2, roll 26 may be inserted into dispenser having dispenser 30 which is a standard type tape dispenser having spindle 32 passing through opening 34 to allow tape roll 26 to be pulled from tape dispenser 30. Spindle 32 passes through opening 34 and is mounted on opposing side walls 36, 36' of tape dispenser 30 to allow unrolling of tape roll 26. Cutter blade 38 may be formed at the frontal portion of tape dispenser 30 to allow the user to easily cut or sever a particular zoned element 18 from the remaining portion of tape roll 26. Subsequent to the user pulling a predetermined number of regions 20 from tape roll 26, the user then severs zoned element 18 into a needed number of regions 20 through use of cutter blade 38. Carrier tape 28 which is generally a plastic type well known in the art is then removed from zoned element 18 and the user may form indicia 14 thereon and then apply such to base surface 12 in a predetermined manner as shown in FIG. 1.

As shown in FIG. 4, zoned elements 18 having predetermined regions 20 are mounted on tape strips 16 formed into pad 40. Pad 40 may include a plurality of tape strips 16 adhered each to the other by adhesive 22 as has previously been described. As seen, adhesive 22 does not entirely coat the rear surface of strips 16, but provides for a non-adhesive portion 23 to facilitate removal of tape 16 from pad 40. Pad 40 having zoned elements 18 further may include markings 24 on each of sheets or strips of tape 16 to provide individual predetermined regions 20 on each strip of tape 16. In this manner, the user may peel a particular tape strip 16 from pad 40 and apply indicia 14 prior to insert onto base surface 12.

It is to be understood that base surface 12 may be a planar board member or may be a sheet layer such as a paper sheet or may be any flat planar surface adaptable for use of mounting of zoned elements 18 thereon.

Figure 5:
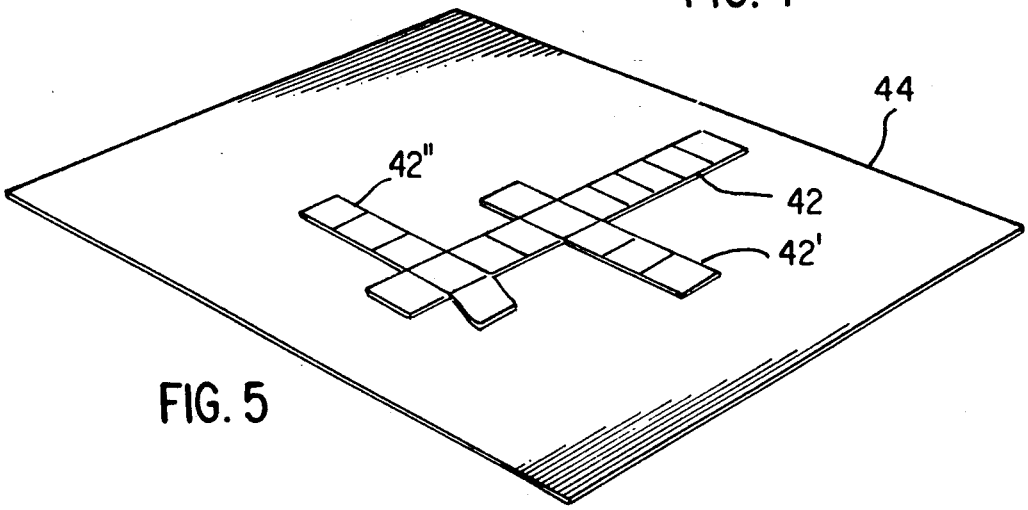
FIG. 5 is a further embodiment of the subject invention concept showing a plurality of mounted metallic zoned elements on a magnetized board.
Figure 6:
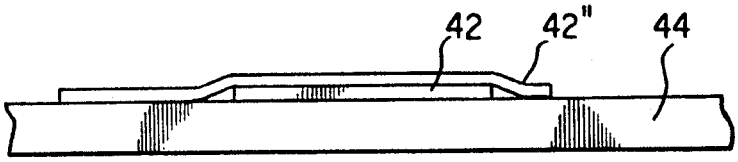
FIG. 6 is an elevational view partially cutaway of the embodiment shown in FIG. 5; and, FIG. 7 is a schematic view of a method of forming a word game showing a first grid layer sheet member having mounted thereon a plurality of zoned elements and a second sheet layer upon which the zoned elements maybe traced.

In an embodiment shown in FIGS. 5 and 6, zoned elements 42, 42' and 42' may be used in conjunction with a metal or commonly referred to magnetic board 44. As is seen, zoned elements 42, 42' and 42' are flexible, magnetized rubber strips having zoned elements formed thereon, and magnetically attractable to magnetic board 44. Further zoned elements 42, 42" and 42' may be formed of a composition which may be written on and wiped off when a compatible marker is used. Metal planar boards 44 are well known in the art and provide a base surface upon which zoned elements 42, 42' and 42" may be removably mounted. Alternatively, and without departing from the scope of the invention, planar board 44 may be magnetized and zoned elements 42, 42' an 42" are metallized on an interfacing surface with board 44. Surfaces of zoned elements 42, 42' and 42" may additionally be formed of a composition which allows application and erasability of indicia formed thereon. In this manner, zoned elements may be relocated and changed and positionally placed with respect to other zoned elements similar to the manner and mechanism previously described.

The subject invention concept further relates to the method of constructing a word puzzle which is individualistic in nature with respect to the person making up the puzzle system 10. Initially, the user selects a group of words relating to a singular topic. The words or indicia 14 may be applied to zoned elements 18, 18' and 18" prior to removably applying such zoned elements to base surface 12.

The user then forms interrelationships of one of the zoned elements 18, 18', 18" with indicia 14 of another of such zoned elements to provide a general overall pattern as shown in FIG. 1. The user may repeatedly remove and reposition the zoned elements in new and differing locations until an overall pattern is decided upon. The plurality of interrelated zoned elements 18, 18' and 18" may then be releasably adhered to the base surface 12 for further presentation.

Figure 7:
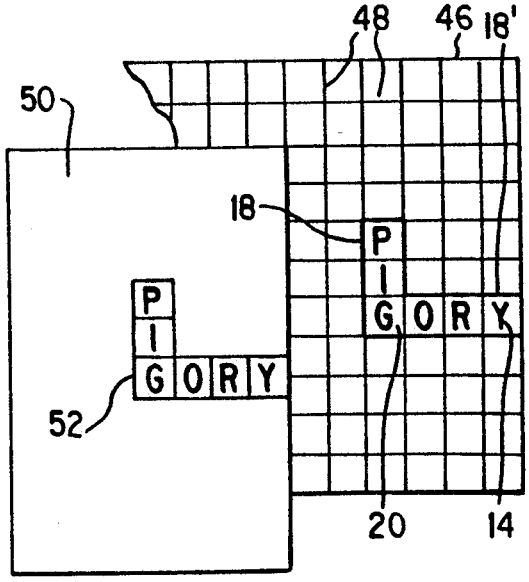

As shown in FIG. 7, the overall pattern from base surface 12 may be transferred to first sheet layer member 46 which includes an indicia grid 48 which corresponds generally to regions 20 of zoned elements 18, however, the individual grid areas are generally smaller than the regions 20 of zoned elements 18. Second sheet layer member 50 may be positionally located over first sheet member 46. The overall contour of zoned elements 18 and 18' may be traced on second sheet layer member 50 to provide an outlined of the overall "L"-shape of the combined zoned elements 18 and 18'. In this particular embodiment shown in FIG. 7, two words are provided, "PIG" and "GORY" having the letter "G" in common. Thus, zoned element 18 is applied over zoned element 18' with the predetermined region 20 having the "G" in overlying and aligned relationship with respect to each other.

When the traced individual zoned elements 18, 18' with predetermined regions 20 are provided on second sheet member 50, such provides an outline of the overall "L"-shaped envelope 52 devoid of particular indicia 14 found on first sheet layer member 46.

The user may develop a "key" on the vocabulary has been determined based upon the overlying relationships of zoned elements 18, 18' and 18". The user may be provided a dictionary to essentially define the words and aid in enhancing the spelling capability of the user. Subsequently, if a cross word puzzle is being formed, individual numbers for words across and down may be provided in conjunction with the definition in the usual manner as provided in crossword puzzle games. Other types of word and number games may be formed using a similar word construction system and method of forming such as has previously been described.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A word construction system comprising:

(a) a base surface;

(b) a plurality of zoned elements, each of said zoned elements having a plurality of delineation markings formed in spaced parallel relation thereon to define predetermined regions disposed between respective pairs of said delineation markings, wherein indicia is applied to said predetermined regions of one of said zoned elements for forming indicia interrelationships with others of said zoned elements; and, (c) means for removably applying each of said plurality of zoned elements to said base surface, at least one of said zoned elements being removably mounted in overlying relationship with another of said zoned elements in a manner that only a first predetermined region of one of said zoned elements is aligned with a second predetermined region of another of said zoned elements, said first and second predetermined regions having substantially identical indicia formed thereon.

2. The word construction system as recited in claim 1 where each of said plurality of zoned elements includes a tape layer having said regions formed on one face thereof and said means for removably applying includes an adhesive coating formed on an opposing face of said tape layer.

3. The word construction system as recited in claim 2 wherein said plurality of zoned elements are formed in a pad of tape layers.

4. The word construction system as recited in claim 2 where each of said zoned elements further includes a carrier layer removably mounted to said adhesively coated face of said tape layer.

5. The word construction system as recited in claim 1 where said plurality of zoned elements are defined by (1) a single tape layer having said regions formed on one face thereof and said means for removably applying disposed on an opposing face, said means for removably applying being defined by an adhesive coating, and (2) a carrier layer removably mounted to said adhesively coated face of said tape layer, said tape layer and said carrier layer being formed into a roll member.

6. The word construction system as recited in claim 5 including a tape dispenser for insert therein of said roll member, said tape layer being subsequently unrolled from said tape dispenser and cut into a predetermined number of regions defining a zoned element to be applied to said base surface.

7. The word construction system as recited in claim 1 where said base surface is formed on a mounting board member having substantially planar opposing faces.

8. The word construction system as recited in claim 1 wherein said zoned elements are formed of a magnetically attractable material composition for releasable securement to said base surface.

9. The word construction system as recited in claim 8 wherein zoned elements include an indicia bearing surface wherein applied indicia are erasable.

10. The word construction system as recited in claim 1 including a grid lined first sheet layer member, said indicia from interrelated zoned elements being transferred to said grid lined first sheet layer.

11. A method of constructing a word puzzle including the steps of:

(a) providing a base surface;

(b) providing a plurality of zoned elements, each of said zoned elements having a plurality of delineation markings formed in spaced parallel relation thereon to define predetermined regions of said zoned element;

(c) providing a collection of words;

(d) providing means for removably applying said plurality of zoned elements to a base surface;

(e) inscribing alphabetic characters on said plurality of zoned elements to form a selected one of said collection of words on each of said plurality of zoned elements, one alphabetic character being inscribed in each of said predetermined regions of said zoned elements;

(f) releasably adhering a selected one of said zoned elements to said base surface;

(g) releasably adhering another of said zoned elements to said base surface in aligned overlying relationship with said selected zoned element to form an interrelationship between said words inscribed on each of said zones elements, said interrelationship being defined by a first predetermined region of one of said zoned elements having a particular alphabetic character disposed thereon being overlaid with a second predetermined region of another of said zoned elements having an identical alphabetic characters disposed thereon; and, (h) releasably adhering a remainder of said plurality of zoned elements to said base surface in aligned overlying relationship with at least one other of said zoned elements.

12. The method of constructing a word puzzle as recited in claim 11 where each of the steps of releasably adhering includes the step of magnetically securing a respective zoned element to said base surface.

13. The method of constructing a word puzzle as recited in claim 11 where each of the steps of releasably adhering includes the step of adhesively securing a respective zoned element to said base surface.

14. The method of constructing a word puzzle as recited in claim 11 including the steps of (1) providing a first sheet layer member, and (2) providing a second sheet layer member.

15. The method of constructing a word puzzle as recited in claim 14 where said first sheet layer member includes an indicia grid having grid areas corresponding to and smaller than areas of said predetermined regions of said zoned elements.

16. The method of constructing a word puzzle as recited in claim 15 where step (h) is followed by the step of transferring said inscribed characters from said zoned elements adhered to said base surface to said first sheet member.

17. The method of constructing a word puzzle as recited in claim 16 including the step of positioning said second sheet layer member over said first sheet layer member.

18. The method of constructing a word puzzle as recited in claim 17 where the step of positioning is followed by the step of tracing an outline of said interrelated zoned elements and said predetermined regions on said second sheet layer member.

* * * * *